United States Patent [19]

Yanagihara

[11] 4,082,067

[45] Apr. 4, 1978

[54] AUTOMATIC FUEL HEATING INJECTION VALVE

[75] Inventor: Shigeru Yanagihara, Kodaira, Japan

[73] Assignee: Agency of Industrial Science & Technology, Tokyo, Japan

[21] Appl. No.: 735,254

[22] Filed: Oct. 26, 1976

[51] Int. Cl.[2] ..... F02B 3/00; F02M 49/02

[52] U.S. Cl. ..... 123/32 H; 123/139 AJ; 239/87; 239/453; 239/533.9

[58] Field of Search ..... 123/32 H, 32 AJ; 239/87, 453, 533.9

[56] References Cited

U.S. PATENT DOCUMENTS

| | | | |
|---|---|---|---|
| 2,935,264 | 5/1960 | Napoli | 123/139 AJ |
| 3,040,989 | 6/1962 | Massal | 239/87 |
| 3,391,680 | 7/1968 | Benson | 239/453 |

*Primary Examiner*—Ronald H. Lazarus
*Attorney, Agent, or Firm*—Haight & Huard

[57] ABSTRACT

An automatic fuel heating injection valve to be mounted in a combustion chamber of an internal combustion engine. The valve has a fuel evaporating chamber which is communicable with the combustion chamber through a fuel injecting port, a stem valve opening and closing the fuel injecting port, and an actuator which operates the stem valve in response to a pressure prevailing in the combustion chamber. A liquid fuel is sufficiently heated en route to the evaporating chamber by the heat of wall and evaporated through a wick of porous and transudatory material in the evaporating chamber. The evaporated fuel is mixed with combustion gas and fresh air in the evaporating chamber, and the mixture is automatically injected in the combustion chamber.

13 Claims, 2 Drawing Figures

AUTOMATIC FUEL HEATING INJECTION VALVE

BACKGROUND OF THE INVENTION

This invention relates to a fuel heating and injection valve for internal combustion engines, and more particularly to a fuel heating and injecting valve which is capable of heating and evaporating a liquid fuel into a gaseous state before injection into a combustion chamber of the engine.

It is an object of the invention to provide a fuel heating and injecting valve to be mounted in a combustion chamber of internal combustion engines. The valve has a fuel evaporating chamber contiguous to a fuel injecting port and an actuator operative in response to pressure variations in the combustion chamber of the engine to operate a valve which controls the opening and closing of the fuel injecting port.

It is another object of the invention to provide a fuel heating and injecting valve which is provided with means for sufficiently heating and evaporating the fuel and mixing with gas prior to the injection into the combustion chamber of the engine so that the injected fuel may be easily mixed with air in the combustion chamber to create readily ignitable and combustible conditions in a wide range of air-fuel ratios.

It is still another object of the invention to provide a fuel heating and injecting valve which utilizes the heat developed by the engine per se in heating and evaporating the fuel and improved combustion conditions for emission control and fuel economy.

The above and other objects, features and advantages of the invention will become apparent from the following description and the appended claims.

SUMMARY OF THE INVENTION

The automatic fuel heating and injecting valve according to the present invention comprises: a generally cylindrical casing capable of being mounted fixedly on a combustion chamber of an internal combustion engine and having an inner end capable of being disposed in the combustion chamber; a fuel injecting port provided at the inner end of the valve casing; an evaporating chamber defined in the casing contiguously to the fuel injecting port at the inner end of the casing and communicable with the combustion chamber of the engine through the fuel injecting port; an actuator operative in response to pressure variations in the engine combustion chamber; a valve mounted in the fuel injecting port and having a stem fixedly connected to the actuator to open and close the fuel injecting port automatically in a proper timing in the cycle of operation of the engine; a fuel chamber provided in the casing on the outer side of the actuator and communicating with a pressurized fuel source through a fuel feeding conduit; and a fuel passage provided axially through the actuator and communicating the fuel chamber with the evaporating chamber.

In a more practical form of the invention, the evaporating chamber is provided with a cylindrical evaporator in the form of a wick of a transudatory porous material and the actuator consists of a cylinder closed at opposite ends and fixedly mounted in the valve casing on the outer side of the evaporating chamber and a piston slidably fitted in the cylinder and defining on opposite sides thereof an outer high pressure chamber and an inner chamber communicating with and in subordination to the pressure in the engine combustion chamber. The piston of the actuator is fixedly connected to the valve stem and normally urged in a valve closing direction by a compression spring which is interposed between the piston and the inner bottom surface of the cylinder but movable in a valve opening direction as soon as a predetermined pressure differential is established between the inner and outer chamber to open the fuel injection port.

DESCRIPTION OF PREFERRED EMBODIMENT

Figure 1:
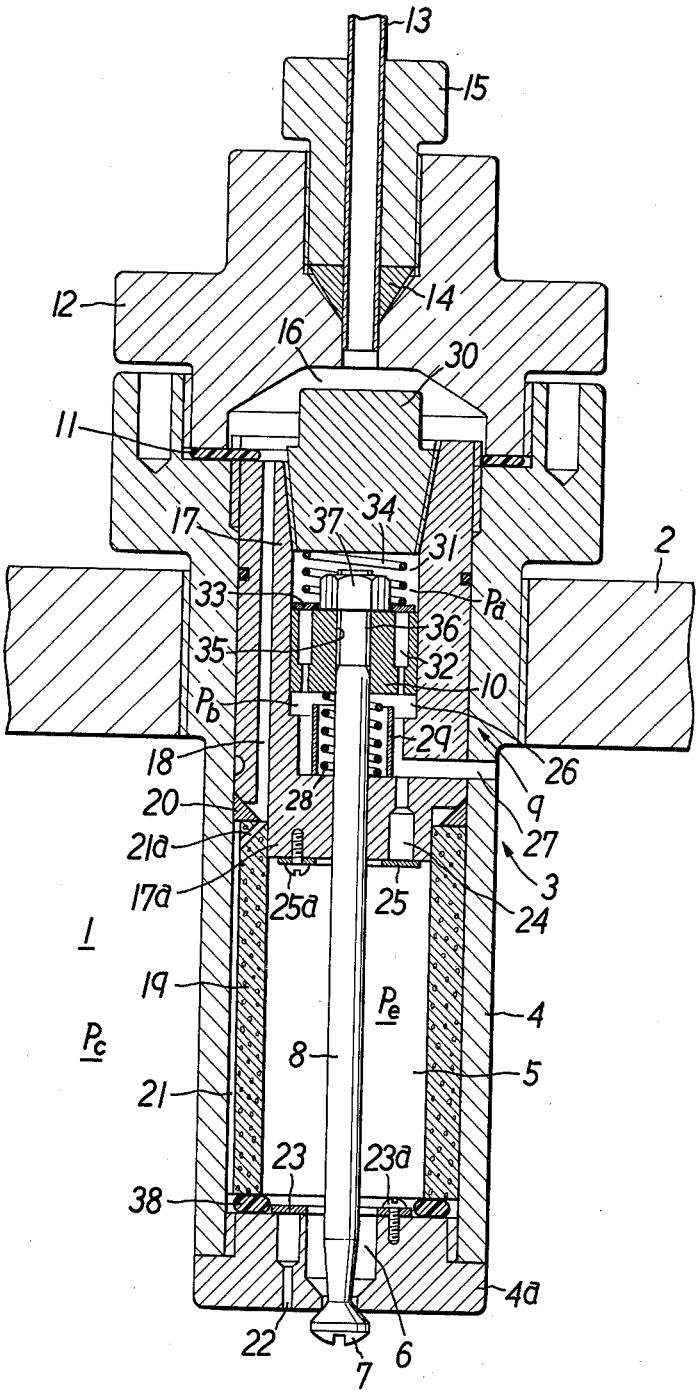
FIG. 1 is a diagrammatic sectional view of an automatic fuel heating and injecting valve according to the instant invention.

Referring to FIG. 1, the automatic fuel vaporizing and injecting valve of the invention is indicated generally at 3 and comprises a housing 4 of cylindrical shape which is securely mounted in a wall 2 of a combustion chamber 1 of an engine. The housing 4 interiorly defines a fuel evaporating chamber 5 with an evaporated fuel injecting port 6 at the inner end which is protruded into the combustion chamber 1. The valve 1 is located in a position on the combustion chamber 1 where an elevated temperature prevails, for the purpose of encouraging the evaporation of the liquid fuel as will be described hereinafter. A valve member 7 is provided at the inner end of a stem 8 which extends axially through the fuel evaporating chamber 5 and the injecting port 6 to open and close the port 6 in relation to the engine operation.

Also accommodated in the housing 4 and on the outer side of the fuel evaporating chamber 5 is an actuator which is, as indicated at 9, hermetically fitted in the housing 4 and includes a cylinder 17 and a piston 10 which is slidably received in the cylinder 17. The outer end of the above-mentioned stem 8 of the valve 7 is passed through the closed inner end of the cylinder 17 and connected securely to the piston 10 for movement therewith.

The valve casing 4 has at its outer end a stepped portion with an annular flange which is closed by and in threaded engagement with an outer plug 12 through a seal 11. The outer plug 12 centrally has a fuel supply port in communication with a conduit 13 which is hermetically connected thereto to by means of a taper 14 and a clamping nut 15 in order to supply a liquid fuel under pressure to a fuel chamber 16 which is formed on the inner side of the outer plug 12. The fuel chamber 16 is in communication with the fuel evaporating chamber 5 through a narrow fuel passage 18 which is formed axially through the wall of the cylinder member 17 of the actuator 9.

The fuel evaporating chamber 5 is provided with a cylindrical evaporator in the form of a wick 19 of heat conductive porous and transudatory material such as sintered metal grains or ceramics. The upper end of the evaporator 19 is fit on a smaller diameter portion at the lower end of the cylinder 17 and held in position in the evaporating chamber 5 by abutment against a seal ring 20 which serves to seal the gap between inner wall surface of the casing 4 and the annular lower end face of the cylinder 17. The lower end of the transudatory evaporator 19 is abutted against the plug 4*a* at the inner end of the casing 4 through a gasket 38. The transudatory evaporator 19 is provided with a suitable number of grooves 21 on the outer periphery thereof to distribute and soak the fuel coming from the passage 18 through a guide groove 21*a*.

The valve casing 4 is provided with a narrow passage 22 through the plug 4*a* to communicate the fuel evaporating chamber 5 with the combustion chamber 1 of the engine. The narrow passage 22 is provided with a flat spring valve 23 which opens and closes the passage 22 in response to pressure differentials between the evaporating chamber 5 and the combustion chamber 1. The cylinder 17 of the actuator 9 is communicable with the evaporating chamber 5 through a narrow passage 24 which is provided through the bottom of the cylinder 17. The narrow passage 24 is opened and closed by a flat spring valve 25 which operates in response to pressure differentials between the evaporating chamber 5 and a lower actuator chamber 26 which will be described hereinlater. Therefore, as soon as the pressure differential between pressure P*c* prevailing in the combustion chamber 1 and pressure P*e* prevailing in the evaporating chamber 5 comes to a predetermined level, hot combustion gas in the combustion chamber 1 is automatically admitted into the evaporating chamber 5.

The cylinder 17 of the actuator 9 defines upper and lower chambers 31 and 26 on opposite sides of the piston 10. The lower chamber 26 communicates with the combustion chamber 1 through a passage 27 which is formed through the walls of the cylinder 17 and valve casing 4, so that the pressure P*b* of the lower chamber 26 is varied in subordination to the pressure P*c* prevailing in the combustion chamber 1. A compression spring 28 is provided in the lower chamber 26 between the piston 10 and the bottom surface of the cylinder 17 to urge the piston 10 outwardly or in the valve closing direction. A cylindrical stopper 29 is mounted around the compression spring 28 to limit the length of stroke in the valve opening direction and at the same time to protect the spring 28 against exposure to hot combustion gases. The upper end of the cylinder 17 is closed by a plug 30. The upper chamber 31 communicates with the lower cylinder chamber 26 through axial passages 32 which are formed through the piston 10. Each one of the passages 32 is provided with a check valve 33 under control of a compression spring 34 to maintain a high pressure level in the upper cylinder chamber 32. Thus the piston 10 is freely slidable within the cylinder 17 in response to the force of spring 28, pressures P*b* and P*a* of the lower and upper cylinder chambers, and pressures P*c* and P*e* of the combustion and evaporating chambers which act on the valve 7.

The upper end portion of the valve stem 8 is received in fitting bore 35 of the piston 10 and fixed thereto by a nut 37 which is threaded on the outer end of the valve stem 8.

With the fuel heating and injecting valve of the above construction, a liquid fuel (preferably preheated) is fed under pressure through the conduit 13 to the fuel chamber 16 and through the narrow passage 18 to the evaporator 19. The liquid fuel is heated sufficiently en route to the evaporating chamber by the hot walls which surround the fuel passages and while it is soaked through the fine pores of the evaporator 19. The heated fuel gushes into the evaporating chamber 5 in the form of finely divided particles or in a gasified state under the influence of reduced pressure or pressure variations in the evaporating chamber 5. There may be employed a transudatory porous evaporator which has catalytic action to encourage the gasification of the fuel under high temperature conditions or to improve the quality of the fuel by thermal or catalytic cracking and reforming. As the transudatory porous evaporator 19 is heated from both sides by the heat which is transferred through the walls of the valve casing 4 and by the hot combustion gas which is admitted into the evaporating chamber 5, the fuel exuding into the evaporating chamber is readily gasified upon mingling with the hot combustion gas to form a gas mixture which is easily ignitable and combustible.

Figure 2:
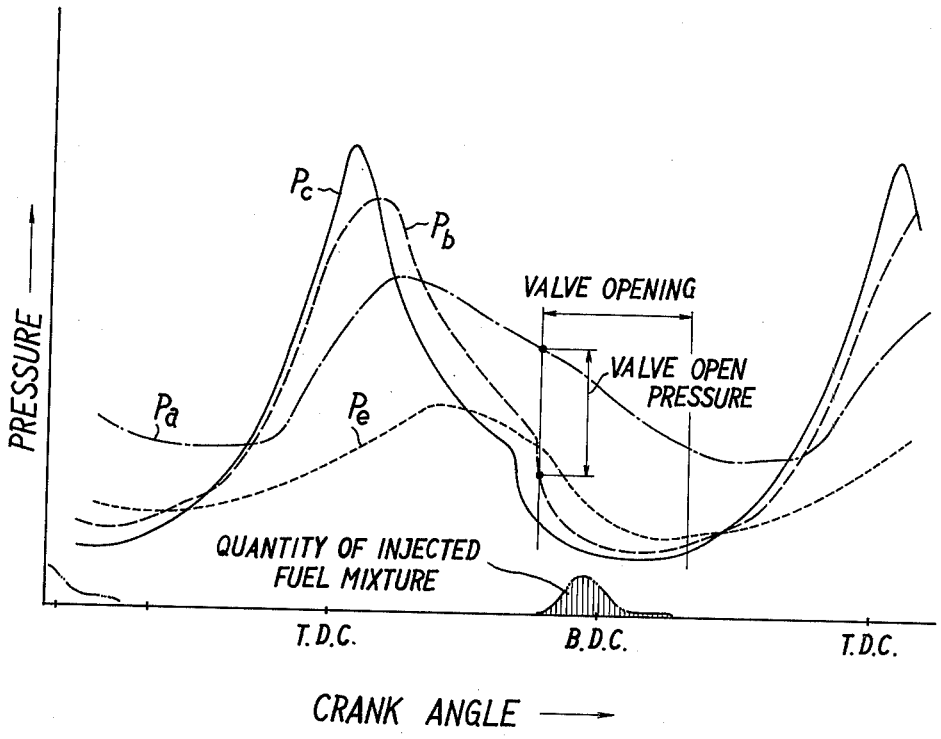
FIG. 2 is a graphic illustration showing the relations between the pressures in the combustion chamber of the engine and in various chambers of the valve.

The graph of FIG. 2 illustrates the pressures in the combustion chamber of the engine and the various chambers of the valve in relation with the crank angle of a two-stroke engine. Under normal operating conditions of the engine, the pressure in the combustion chamber of the two-stroke engine varies as shown in P*c*, while the pressure in the inner and outer chambers 26 and 31 of the actuator vary as shown at P*b* and P*a*, respectively. The outer chamber 31 picks up pressure during the compression stroke of the engine due to gases gas flows leaking thereinto through the clearance around the piston 10 and through the check valves 33. The pressure P*e* in the evaporating chamber 5 is varied as shown at P*e* under the influence of the evaporated fuel gases and the combustion gases which are admitted through the narrow passages 22 and 24.

When the pressure P*c* of the combustion chamber 1 drops during the exhaust stroke of the engine, the pressure P*b* of the inner chamber 26 is accordingly dropped to develop across the piston 10 a pressure differential which overcome the action of the spring 28, the valve 7 is opened immediately, letting the gasified fuel mixture gushingly flow into the combustion chamber 1 through the injecting port 6 according to the open angle of the valve 7 and the pressure differential between pressure P*e* of the evaporating chamber 5 and pressure P*c* of the combustion chamber 1. As soon as the pressure in the outer chamber 31 drops to a certain level, the valve 7 is closed by the biasing action of the compression spring 28.

The fuel gas injected into the combustion chamber 1 can thus form a combustible gas mixture upon mingling with fresh air which is drawn into the combustion chamber in the usual manner, developing extremely good combustible conditions during the succeeding compression stroke followed by ignition.

It will be understood from the foregoing description that the automatic fuel heating and injecting valve according to the invention advantageously utilizes the heat which is developed in the combustion chamber of the engine, in heating and gasifying the fuel to provide the better mixture of the fuel with fresh air before the combustion, thereby creating remarkably good ignitable and combustible conditions under which satisfactory combustion process can be obtained in a wide range of air-fuel ratio for controlling the exhaust emissions and improving fuel economy.

What is claimed is:

1. An automatic fuel heating and injection valve assembly comprising:

a generally cylindrical casing capable of being mounted fixedly in heat exchange relationship on a combustion chamber of an internal combustion engine and having an inner end capable of being disposed in said combustion chamber;

a fuel injecting port provided at said inner end of said casing;

an evaporating chamber defined in said casing contiguous to said inner end and communicable with said combustion chamber through said fuel injecting port such that heat is exchanged from said combustion chamber to said evaporating chamber by way of said cylindrical casing to aid in fuel evaporation;

an actuator mounted in said casing on the outer side of said evaporating chamber and operative in response to pressure variations in said combustion chamber;

a valve mounted in said fuel injecting port and having a stem connected to said actuator to open and close said fuel injecting port in response to said pressure variations in said combustion chamber;

a fuel chamber provided in said casing on the outer side of said actuator and communicating with a pressurized fuel source through a fuel feeding conduit; and a fuel passage provided axially through said actuator and communicating said fuel chamber with said evaporating chamber.

2. An automatic fuel heating and injection valve according to claim 1, wherein an evaporator of a cylindrical porous material is disposed in said evaporating chamber to cover the inner wall surfaces thereof.

3. An automatic fuel heating and injection valve according to claim 2, wherein said evaporator has a number of axial grooves on the outer periphery thereof to distribute the fuel received from said fuel passage in said actuator.

4. An automatic fuel heating and injection valve according to claim 1, wherein said actuator includes a cylinder closed at opposite ends and fixedly mounted in said casing on the outer side of said evaporating chamber and a piston slidably fitted in said cylinder and defining on opposite sides an outer high pressure chamber and an inner chamber of a pressure varying in subordination to the pressure in said combustion chamber, said piston being fixedly connected to said valve stem and normally urged in a valve closing direction by a biasing means but movable in a valve opening direction as soon as a predetermined pressure differential is established between said inner and outer chambers to open said fuel injecting port.

5. An automatic fuel heating and injection valve according to claim 4, wherein said biasing means is a compression spring mounted in said inner chamber between said piston and the inner bottom surface of said cylinder.

6. An automatic fuel heating and injection valve according to claim 5, wherein said actuator further comprises a cylindrical stopper around said compression spring to limit the inward stroke of said piston to a predetermined distance and to protect said compression spring against exposure to hot combustion gases.

7. An automatic fuel heating and injection valve according to claim 4, further comprising a passage communicating said inner chamber with said combustion chamber of the engine and a number of narrow one-way passages to draw high pressure from said combustion chamber to said evaporating chamber and from said inner chamber to said evaporating chamber and outer chamber.

8. An automatic fuel heating and injection valve according to claim 7, wherein the inner end of said casing is closed by and in threaded engagement with a plug having said fuel injecting port and one of said one-way passages.

9. An automatic fuel heating and injection valve according to claim 7, wherein an evaporator is tightly held against the bottom of said evaporating chamber by said cylinder through a seal ring and a gasket.

10. An automatic fuel heating and injection valve according to claim 4, wherein said inner chamber communicates with said combustion chamber through a radial passage formed through the walls of said cylinder and casing.

11. An automatic fuel heating and injection valve according to claim 1, wherein said casing is provided with an annular stepped wall portion at the outer end there of and closed by a flanged plug securely threaded into said stepped wall portion.

12. An automatic fuel heating and injection valve according to claim 11, wherein said plug is centrally provided with a fuel inlet hermetically connected to said fuel conduit.

13. An automatic fuel heating and injection valve according to claim 12, wherein said fuel conduit is connected to said fuel inlet by means of a taper and a bored bolt.

* * * * *

UNITED STATES PATENT AND TRADEMARK OFFICE

CERTIFICATE OF CORRECTION

PATENT NO. : 4,082,067

DATED : April 4, 1978

INVENTOR(S) : Shigeru Yanagihara

It is certified that error appears in the above–identified patent and that said Letters Patent are hereby corrected as shown below:

In the heading, the following additional information should appear:

[30] Foreign Application Priority Data

October 29, 1975 Japan 49-130146

Signed and Sealed this

*Fifth* Day of *June 1979*

[SEAL]

*Attest:*

RUTH C. MASON
*Attesting Officer*

DONALD W. BANNER
*Commissioner of Patents and Trademarks*